US006531037B2

(12) United States Patent
Ohmori

(10) Patent No.: US 6,531,037 B2
(45) Date of Patent: Mar. 11, 2003

(54) REMOVABLE ELECTRODE

(75) Inventor: Hitoshi Ohmori, Wako (JP)

(73) Assignee: Riken (JP)

( * ) Notice: Subject to any disclaimer, the term of this patent is extended or adjusted under 35 U.S.C. 154(b) by 118 days.

(21) Appl. No.: 09/796,629

(22) Filed: Mar. 2, 2001

(65) Prior Publication Data

US 2001/0020585 A1 Sep. 13, 2001

(30) Foreign Application Priority Data

Mar. 9, 2000 (JP) ..... 2000-065048

(51) Int. Cl.[7] ..... C25F 7/00; C25B 11/02
(52) U.S. Cl. ..... 204/217; 204/286.1; 204/290.01
(58) Field of Search ..... 204/217, 286.1, 204/290.01

(56) References Cited

U.S. PATENT DOCUMENTS

| | | | | |
|---|---|---|---|---|
| 3,619,386 A | * | 11/1971 | Eisner | 205/87 |
| 3,816,291 A | * | 6/1974 | Inoue | 204/224 M |
| 4,849,599 A | * | 7/1989 | Kuromaisu | 204/224 M |
| 5,194,126 A | * | 3/1993 | Packalin | 204/272 |
| 5,639,363 A | | 6/1997 | Ohmori et al. | |
| 5,667,646 A | | 9/1997 | Tomotaki | |

FOREIGN PATENT DOCUMENTS

| | | |
|---|---|---|
| EP | 0 920 958 A | 6/1999 |
| JP | 07-310861 A | 12/1995 |

OTHER PUBLICATIONS

Patent Abstracts of Japan, vol. 13, No. 036 (M–790), Jan. 26, 1989 & JP 63–245370 A, Agency of Ind. Science & Technol., Oct. 12, 1988.

* cited by examiner

*Primary Examiner*—Donald R. Valentine
(74) *Attorney, Agent, or Firm*—Griffin & Szipl, P.C.

(57) ABSTRACT

There is disclosed a removable electrode for electrolytic dressing grinding in which the electrode is disposed opposite to a processing surface of a conductive grinding wheel via a gap, a conductive liquid is passed through between the electrode and the conductive grinding wheel to apply a voltage thereto, the grinding wheel is dressed by electrolysis and a workpiece is simultaneously ground, the electrode comprising: an electrode support member 12 having a surface 12*a* disposed opposite to the processing surface of the grinding wheel via a constant gap; a conductive foil 14 detachably attached to and along the opposite surface of the electrode support member; and a conductive terminal 16 for contacting the conductive foil to apply the voltage to the conductive foil. Even when a deposit is built up on a cathode surface, the cathode surface can be cleaned in a short time. Even after repeated use, an electrode shape does not change. Therefore, an ELID grinding apparatus can steadily be operated in an unmanned manner for a long time.

4 Claims, 3 Drawing Sheets

REMOVABLE ELECTRODE

BACKGROUND OF THE INVENTION

1. Field of the Invention

The present invention relates to an electrode for electrolytic dressing grinding, more particularly to a removable electrode whose surface can be exchanged in a short time.

2. Description of the Related Art

In recent years, with development of scientific technique, a demand for superfine processing has rapidly escalated, and as mirror surface grinding means for satisfying the demand, an electrolytic in-process dressing grinding method (ELID grinding method) has been developed, and presented by the present applicant, et al. ("Trend of Latest Technique of Mirror Surface Grinding" of Riken symposium held on Mar. 5, 1991).

As schematically shown in FIG. 1, the ELID grinding method includes: using a conductive grinding wheel 1 instead of an electrode in conventional electrolytic grinding; disposing an electrode 2 opposite to the grinding wheel via a gap; passing a conductive liquid 3 through between the grinding wheel and the electrode while applying a voltage to between the grinding wheel 1 and the electrode 2; dressing the grinding wheel by electrolysis; and simultaneously grinding a workpiece by the grinding wheel. That is to say, in the grinding method, the metal bond grinding wheel 1 is used as an anode, the electrode 2 disposed opposite to the surface of the grinding wheel via the gap is used as a cathode, and electrolytic dressing of the grinding wheel is performed simultaneously with a grinding operation, so that grinding properties can be maintained and stabilized. Additionally, in FIG. 1, reference numeral 4 is a workpiece (material to be ground), 5 is an ELID power supply, 6 is a power supply member, and 7 is a nozzle of the conducive solution.

In this ELID grinding method, even when an abrasive grain is fine, the grinding wheel is dressed through electrolytic dressing and prevented from being clogged. Therefore, with the fine abrasive grain, a processed surface remarkably superior like a mirror surface can be obtained by a grinding process. Therefore, in the ELID grinding method, sharpness of the grinding wheel can be maintained both of highly efficient grinding and mirror surface grinding, and the method is expected to be applied to various grinding processes as means able to create a highly precise surface in a short time, which has been impossible in a conventional art.

In the aforementioned ELID grinding, a metal component of a grinding wheel bonding material is deposited on the surface of the cathode 2 disposed opposite to the metal bond grinding wheel 1 as the anode based on an electric plating principle, contrary to an anode reaction which is electrolytic eluation of the grinding wheel bonding material.

Since the deposit on the surface of the cathode has a composition close to that of a pure metal in principle, conductivity is not lost. However, when the ELID grinding process is performed over a long time, following problems would occur. 1. The gap between the cathode and the grinding wheel is filled with the deposit, the surface of the electrode becomes irregular, and electrolytic dressing of the grinding wheel becomes unstable. 2. A sufficient amount of grinding solution cannot steadily be supplied after a long time. To solve the problems, in the conventional art, the apparatus would be stopped every several days (about one to seven days), a distance between the electrode and the grinding wheel is enlarged, or the electrode is removed from the apparatus, and the deposit sticking to the surface of the electrode is removed with a sand paper or the like. As a result, however, following other problems would occur. 3. An apparatus maintenance time is lengthened, continuous operation is limited and operating efficiency is deteriorated. 4. After repeated maintenance, an electrode surface shape changes, the entire electrode needs to be exchanged, much time is therefore required for changing the electrode and readjusting the entire apparatus, and the operating efficiency is further deteriorated. Consequently, an ELID grinding effect cannot be maintained during continuous unmanned operation, and it has been recognized that these problems have to be overcome for complete automatic operation.

SUMMARY OF THE INVENTION

The present invention has been developed to solve the problems. That is to say, an object of the present invention is to provide an electrode for electrolytic dressing grinding, in which even with a deposit built up on a cathode surface the cathode surface can be cleaned in a short time, even after repeated use an electrode shape does not change, and an ELID grinding apparatus can therefore steadily be operated in an unmanned manner for a long time.

According to the present invention, there is provided a removable electrode for electrolytic dressing grinding in which the electrode is disposed opposite to a processing surface of a conductive grinding wheel via a gap, a conductive liquid is passed through the gap to apply a voltage to the gap, the grinding wheel is dressed by electrolysis and a workpiece is simultaneously ground, the electrode comprising: an electrode support member (12) having a surface **(12*a*) disposed opposite to the processing surface of the grinding wheel via a constant gap; a conductive foil (14) detachably attached to and along the opposite surface of the electrode support member; and a conductive terminal (16)** for contacting the conductive foil to apply the voltage to the conductive foil.

According to the aforementioned constitution of the present invention, since the electrode support member (12) is provided with the opposite surface **(12*a*), the conductive foil can be disposed opposite to the processing surface of the conductive grinding wheel via the gap simply by attaching the conductive foil (14) to and along the opposite surface. Therefore, in this state, it is possible to perform the electrolytic dressing grinding (ELID grinding) by applying the voltage to the conductive foil via the conductive terminal (16)**, passing the conductive liquid through between the conductive foil and the conductive grinding wheel, dressing the grinding wheel by electrolysis, and simultaneously grinding the workpiece.

Moreover, the conductive foil (14) is detachably attached to the opposite surface of the electrode support member. Therefore, even when the deposit is built up on the electrode surface, the electrode surface can be cleaned in a short time simply by changing the conductive foil. Furthermore, even when the conductive foil is repeatedly exchanged, the electrode shape does not change, so that the ELID grinding apparatus can steadily be performed in the unmanned manner for the long time.

According to a preferred embodiment of the present invention, the conductive foil (14) is applied to the opposite surface **(12*a*)** in a single layer or laminated layers.

When the conductive foil is of the single layer, the conductive foil can be exchanged and the electrode surface can be cleaned only by stripping the conductive foil (14)

from the electrode support member (12) and attaching another new conductive foil to the electrode support member. Moreover, when the conductive foil is of multiple layers, the surface conductive foil with the deposit thereon is simply stripped from the multiple layers, and the underlying conductive foil is in turn disposed opposite to the processing surface of the conductive grinding wheel via the gap, so that ELID grinding can be performed.

When the conductive foil (14) is formed in a tape shape, the conductive foil is preferably intermittently or continuously moved along the opposite surface (12*a*).

In this constitution, a portion of the conductive foil with the deposit built up thereon can intermittently or continuously be replaced with a new portion on which no deposit is built up, and the ELID grinding apparatus can steadily be operated in the unmanned manner for a long time.

Furthermore, the electrode support member (12) is preferably formed of an insulating material, and may be provided with a guide groove (13) via which the conductive foil is movably guided along the opposite surface (12*a*).

According to this constitution, while the conductive foil (14) is disposed opposite to the processing surface of the conductive grinding wheel via the constant gap, the portion of the conductive foil with the deposit built up thereon can be replaced with the new portion via the guide groove (13).

Other objects and advantages of the present invention will be apparent from the following description with reference to the accompanying drawings.

DETAILED DESCRIPTION OF THE PREFERRED EMBODIMENTS

Figure 1:
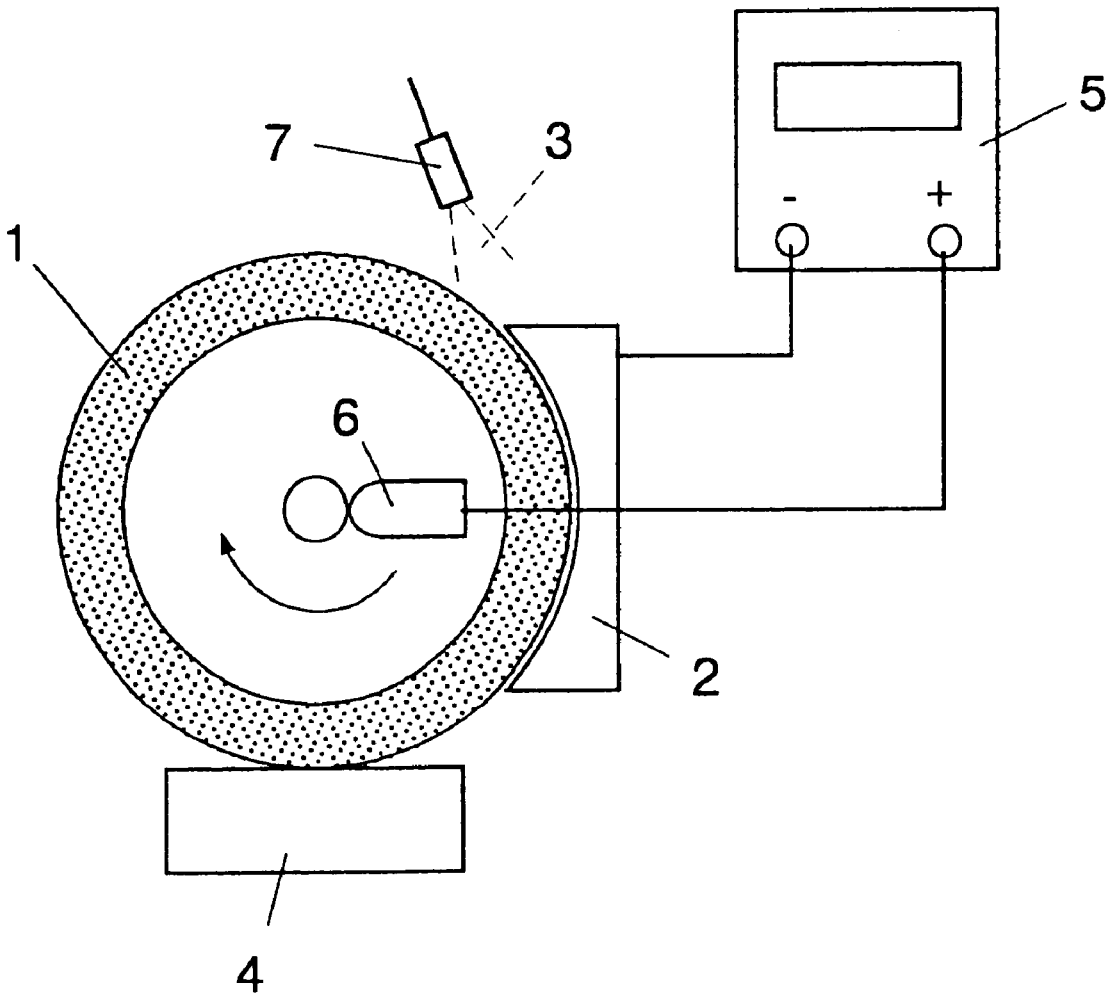
FIG. 1 is a schematic view of an ELID grinding apparatus.

Preferred embodiments of the present invention will be described hereinafter with reference to the accompanying drawings. Additionally, a portion common to the respective diagrams is denoted with the same reference numeral, and redundant description thereof is omitted.

Figure 2A:
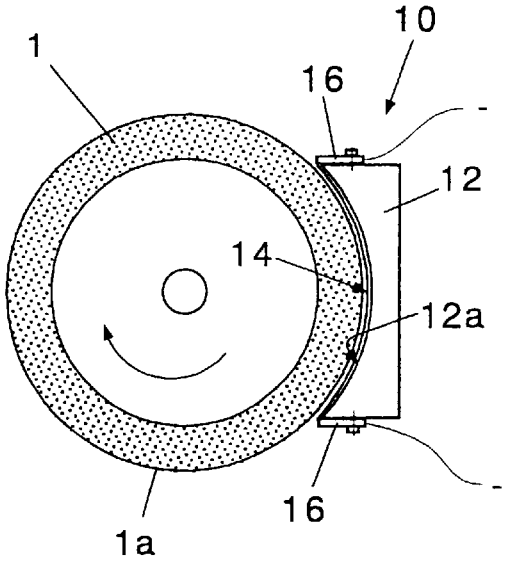
FIGS. 2A to 2D are structure diagrams of a removable electrode for a straight grinding wheel according to the present invention.
Figure 2B:
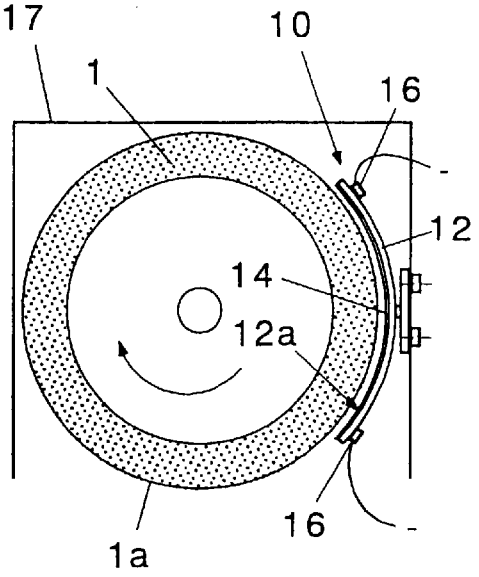
Figure 2C:
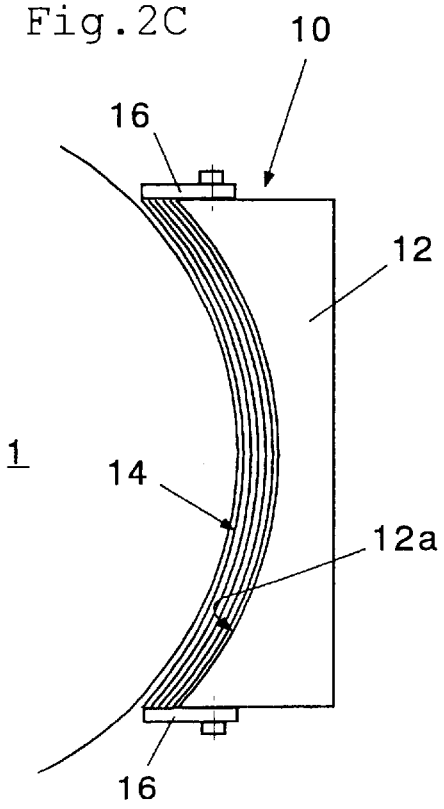
Figure 2D:
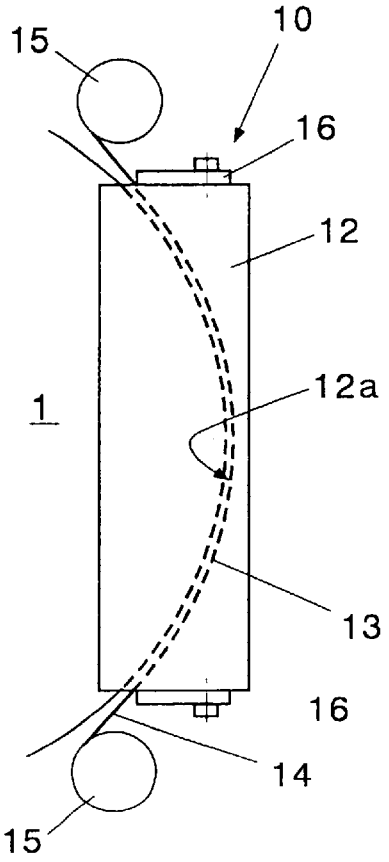

FIGS. 2A to 2D are structure diagrams of a removable electrode for a straight grinding wheel according to the present invention. In the drawings, FIG. 2A shows a first embodiment, FIG. 2B shows a second embodiment, FIG. 2C shows a third embodiment, and FIG. 2D shows a fourth embodiment. As shown in FIGS. 2A to 2D, a removable electrode 10 of the present invention is disposed opposite to a processing surface 1*a* of a conductive grinding wheel 1 (straight grinding wheel in this example) via a gap. This electrode 10 is for use in electrolytic dressing grinding in which a conductive liquid is passed through the gap to apply a voltage to the gap, the grinding wheel 1 is dressed by electrolysis and a workpiece is simultaneously ground. In this respect, the electrode has the same function as that of the conventional electrode 2 shown in FIG. 1.

In the first embodiment of FIG. 2A, the removable electrode 10 of the present invention is provided with an electrode support member 12, conductive foil 14 and conductive terminal 16.

The electrode support member 12 has an opposite surface 12*a* which is disposed opposite to the processing surface 1*a* of the straight grinding wheel 1 via a constant gap. The constant gap is, for example, of the order of 0.1 mm to 0.3 mm. Moreover, the electrode support member 12 is preferably formed of an insulating material (e.g., plastic).

The conductive foil 14 is detachably attached to and along the opposite surface 12*a* of the electrode support member 12. This conductive foil 14 is a foil, for example, of copper, brass, aluminum, gold, stainless steel, or the like. A thickness of the conductive foil 14 is arbitrary, but is, for example, of the order of 10 $\mu$m to 50 $\mu$m.

In this example, the conductive terminal 16 is fixed to the electrode support member 12 with a screw or the like so as to contact the conductive foil 14. A negative (minus) voltage is applied to the conductive terminal 16 from a power supply (not shown). Additionally, in this example, a pair of conductive terminals 16 are attached to upper and lower surfaces of the electrode support member, the same voltage is applied to the conductive terminals, and a voltage between the conductive terminals is equalized. However, the conductive terminal 16 may be disposed on either one surface.

Moreover, different from the embodiment shown in the drawing, for example, the conductive terminal may be passed through the electrode support member 12 to contact the conductive foil 14. Alternatively, a part or the whole of the electrode support member 12 is constituted of a conductive material, and a part of the electrode support member is brought in contact with the conductive foil 14. In this case, the conductive terminal may be omitted.

Furthermore, in the first embodiment of FIG. 2A, the single-layer conductive foil 14 is applied to the opposite surface 12*a* of the electrode support member 12 using a removable adhesive.

According to the aforementioned constitution of the present invention, the electrode support member 12 is provided with the opposite surface 12*a*. Therefore, when the conductive foil 14 is applied to and along the opposite surface 12*a*, the conductive foil 14 can be disposed opposite to the processing surface 1*a* of the conductive grinding wheel via an appropriate gap (e.g., about 0.1 mm to 0.3 mm). Therefore, in this state, the voltage is applied to the conductive foil 14 via the conductive terminal 16, the conductive liquid is passed through between the conductive foil and the conductive grinding wheel 1, and the grinding wheel is dressed by electrolysis, while the workpiece can be ground with the grinding wheel.

Moreover, the single-layer conductive foil 14 is detachably attached to the opposite surface 12*a* of the electrode support member 12 with the adhesive. Therefore, even when a deposit is built up on the surface of the electrode, the conductive foil can be exchanged, and the electrode surface can be cleaned in a short time simply by stripping the conductive foil 14 from the electrode support member 12 and attaching another new conductive foil 14 to the electrode support member. Moreover, even when replacement of the conductive foil 14 is repeated, an electrode shape does not change, and an ELID grinding apparatus can therefore steadily be operated in an unmanned manner for a long time.

In the second embodiment of FIG. 2B, the electrode support member 12 is formed of a thin (e.g., 2 to 5 mm,thick) metal plate, and the single-layer conductive foil 14 is detachably attached to an inner surface (opposite surface 12*a*) of the electrode support member with the adhesive. Moreover, in the present embodiment, the grinding wheel 1 is enclosed with a grinding wheel cover 17, and the electrode support member 12 is detachably attached to an inner surface of the grinding wheel cover with a bolt, and the like. The other constitution is similar to that of the first embodiment.

According to this constitution, similarly as the first embodiment, the conductive foil 14 is disposed opposite to the processing surface 1*a* of the conductive grinding wheel via the appropriate gap (e.g., about 0.1 mm to 0.3 mm), and the grinding wheel is dressed by electrolysis while the workpiece can be ground.

Moreover, since the electrode support member 12 is detachably attached to the inner surface of the grinding wheel cover 17, the electrode support member 12 is detached from the cover, and the conductive foil 14 is simply replaced with another new conductive foil 14, so that the conductive foil can easily be exchanged.

In the third embodiment of FIG. 2C, the conductive foils 14 are laminated and attached onto the opposite surface 12*a* of the electrode support member 12. The other constitution is similar to that of the first embodiment.

According to this constitution, when the surface conductive foil 14 with the deposit built up thereon by ELID grinding is simply stripped, the underlying conductive foil 14 is in turn disposed opposite to the processing surface 1*a* of the conductive grinding wheel 1 via the gap, so that the ELID grinding can continuously be performed. Additionally, in this case, when a thick conductive foil (e.g., 30 to 50 $\mu$m) is used, the gap between the conductive foil and the processing surface 1*a* slightly changes, but the ELID grinding is only slightly influenced. Therefore, on the same conditions, or by automatically controlling the voltage or the like of ELID power supply, the ELID grinding apparatus can steadily be operated in the unmanned manner for a long time.

In the fourth embodiment of FIG. 2D, the conductive foil 14 is formed in a tape shape. Moreover, the electrode support member 12 is constituted of the insulating material (e.g., plastic), and is intermittently or continuously moved between a pair of reels 15. Furthermore, the electrode support member 12 is provided with a guide groove 13 via which the tape-shaped conductive foil 14 is movably guided along the opposite surface 12*a*. For example, the guide groove 13 is a groove having a circular arc shape via which both ends of a width direction of the tape-shaped conductive foil 14 are guided along the opposite surface 12*a*. The other constitution is similar to that of the first embodiment.

According to this constitution, the conductive foil 14 is intermittently or continuously moved via the guide groove 13 while the conductive foil is disposed opposite to the processing surface of the conductive grinding wheel via the constant gap. Moreover, when the deposit is built up on a portion of the conductive foil 14, the portion can intermittently or continuously be replaced with a new portion, and the ELID grinding apparatus can steadily be operated in the unmanned manner for a long time.

Figure 3A:
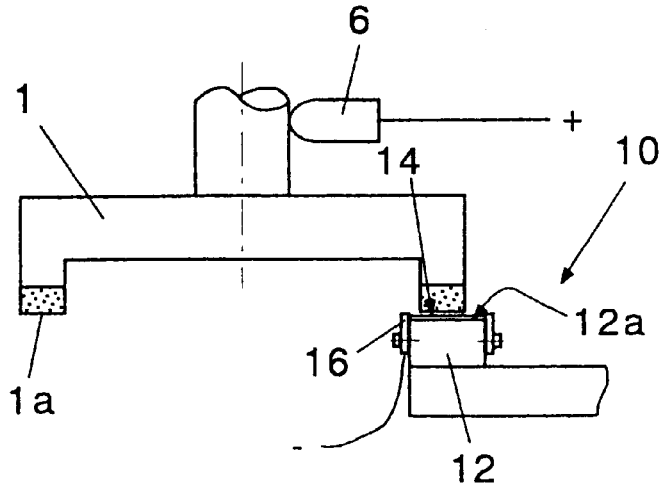
FIGS. 3A to 3C are structure diagrams of the removable electrode for a cup type grinding wheel according to the present invention.
Figure 3B:
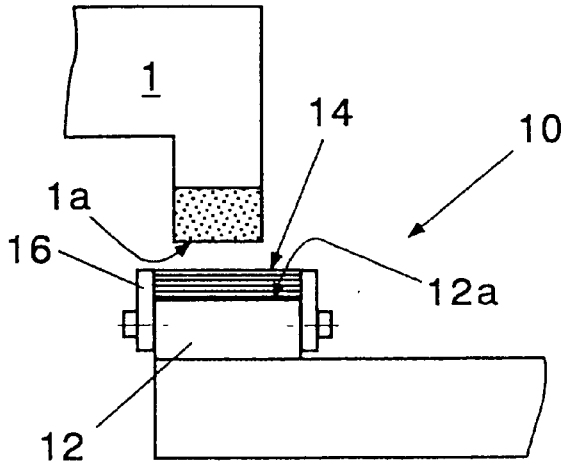
Figure 3C:
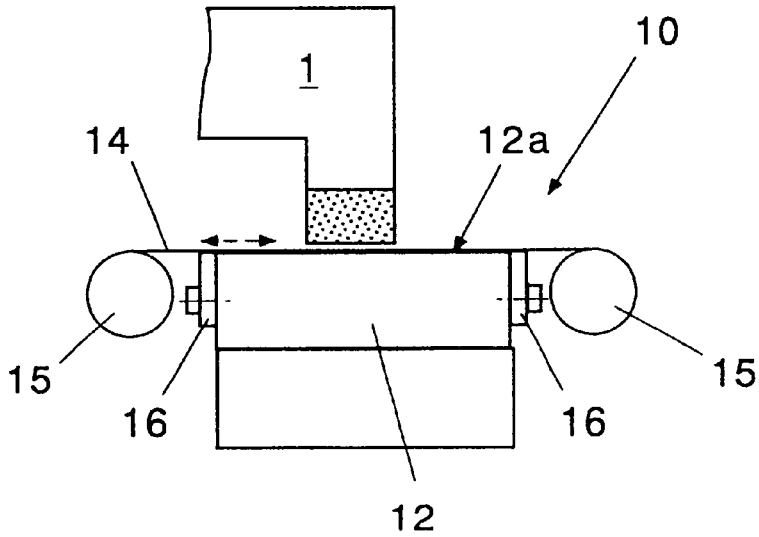

FIGS. 3A to 3C are structure diagrams of the removable electrode for a cup type grinding wheel according to the present invention. In the drawings, FIG. 3A shows a fifth embodiment, FIG. 3B shows a sixth embodiment, and FIG. 3C shows a seventh embodiment. Additionally, as shown in FIGS. 3A to 3C, the removable electrode 10 of the present invention is disposed opposite to the processing surface 1*a* of the conductive grinding wheel 1 (cup type grinding wheel in this example) via the gap. This electrode is for use in electrolytic dressing grinding in which the conductive liquid is passed through the gap to apply the voltage to the gap, the grinding wheel 1 is dressed by electrolysis and the workpiece is simultaneously ground. In this respect, the electrode has the same function as that of the conventional electrode 2 shown in FIG. 1.

In the fifth embodiment of FIG. 3A, the removable electrode 10 of the present invention is provided with the electrode support member 12, conductive foil 14 and conductive terminal 16.

The electrode support member 12 has the opposite surface 12*a* which is disposed opposite to the processing surface 1*a* of the grinding wheel 1 via the constant gap. The constant gap is, for example, of the order of 0.1 mm to 0.3 mm. Moreover, the electrode support member 12 is preferably formed of the insulating material (e.g., plastic).

The conductive foil 14 is detachably attached to and along the opposite surface 12*a* of the electrode support member 12. This conductive foil 14 is a foil, for example, of copper, brass, aluminum, gold, stainless steel, or the like. The thickness of the conductive foil 14 is arbitrary, but is, for example, of the order of 10 $\mu$m to 50 $\mu$m.

In this example, the conductive terminal 16 is fixed to the electrode support member 12 with the screw or the like so as to contact the conductive foil 14. The negative (minus) voltage is applied to the conductive terminal 16 from the power supply (not shown). Additionally, in this example, a pair of conductive terminals 16 are attached to opposite surfaces of the electrode support member, the same voltage is applied to the respective conductive terminals, and the voltage between the conductive terminals is equalized. However, the conductive terminal 16 may be disposed on either one surface.

Moreover, different from the embodiment shown in the drawing, for example, the conductive terminal may be passed through the electrode support member 12 to contact the conductive foil 14. Alternatively, a part or the whole of the electrode support member 12 is constituted of a conductive metal, and a part of the electrode support member is brought in contact with the conductive foil 14. In this case, the conductive terminal may be omitted.

Furthermore, in the fifth embodiment of FIG. 3A, the single-layer conductive foil 14 is applied to the opposite surface 12*a* of the electrode support member 12 using the removable adhesive.

According to the aforementioned constitution of the present invention, the electrode support member 12 is provided with the opposite surface 12*a*. Therefore, when the conductive foil 14 is applied to and along the opposite surface 12*a*, the conductive foil 14 can be disposed opposite to the processing surface 1*a* of the conductive grinding wheel via the appropriate gap (e.g., about 0.1 mm to 0.3 mm). Therefore, in this state, the voltage is applied to the conductive foil 14 via the conductive terminal 16, the conductive liquid is passed through between the conductive foil and the conductive grinding wheel 1, and the grinding wheel is dressed by electrolysis, while the workpiece can be ground with the grinding wheel.

Moreover, the single-layer conductive foil 14 is detachably attached to the opposite surface 12*a* of the electrode support member 12 with the adhesive. Therefore, even when the deposit is built up on the surface of the electrode, the conductive foil can be exchanged, and the electrode surface can be cleaned in a short time simply by stripping the conductive foil 14 from the electrode support member 12 and attaching another new conductive foil 14 to the electrode support member. Moreover, even when replacement of the conductive foil 14 is repeated, the electrode shape does not change, and the ELID grinding apparatus can therefore steadily be operated in the unmanned manner for a long time.

In the sixth embodiment of FIG. 3B, the conductive foils 14 are laminated and attached onto the opposite surface 12*a* of the electrode support member 12. The other constitution is similar to that of the fifth embodiment.

According to this constitution, when the surface conductive foil 14 with the deposit built up thereon by ELID grinding is simply stripped, the underlying conductive foil 14 is in turn disposed opposite to the processing surface 1*a* of the conductive grinding wheel 1 via the gap, so that the ELID grinding can continuously be performed. Additionally, in this case, when the thick conductive foil (e.g., 30 to 50 μm) is used, the gap between the conductive foil and the processing surface 1*a* slightly changes, but the ELID grinding is only slightly influenced. Therefore, on the same conditions, or by automatically controlling the voltage or the like of the ELID power supply, the ELID grinding apparatus can steadily be operated in the unmanned manner for a long time.

In the seventh embodiment of FIG. 3C, the conductive foil 14 is formed in the tape shape. Moreover, the electrode support member 12 is constituted of the insulating material (e.g., plastic), and is intermittently or continuously moved between a pair of reels 15. The other constitution is similar to that of the first embodiment.

According to this constitution, the conductive foil 14 is intermittently or continuously moved between the pair of reels 15 while the conductive foil is disposed opposite to the processing surface 1*a* of the conductive grinding wheel 1 via the constant gap. Moreover, when the deposit is built up on a portion of the conductive foil 14, the portion can intermittently or continuously be replaced with a new portion, and the ELID grinding apparatus can steadily be operated in the unmanned manner for a long time.

As described above, according to the removable electrode of the present invention, even when the deposit is built up on a cathode surface, the cathode surface can be cleaned in a short time. Moreover, even after repeated use, the electrode shape does not change. Therefore, the ELID grinding apparatus can steadily be operated in the unmanned manner for a long time, and other superior effects can be produced.

Additionally, the present invention is not limited to the aforementioned embodiments or examples, and these can of course be modified in various ways without departing from the scope of the present invention. For example, the removable electrode of the present invention is not limited to the electrode for electrolytic dressing grinding illustrated in FIG. 1, and the present invention can be applied to any electrode for electrolytic dressing grinding.

What is claimed is:

1. A removable electrode for electrolytic dressing grinding in which the electrode is disposed opposite to a processing surface of a conductive grinding wheel via a gap, a conductive liquid is passed through between the electrode and the conductive grinding wheel to apply a voltage to between the electrode and the conductive grinding wheel, the grinding wheel is dressed by electrolysis and a workpiece is simultaneously ground, the removable electrode comprising:

an electrode support member having a surface disposed opposite to the processing surface of the grinding wheel via a constant gap; a conductive foil detachably attached to and along the opposite surface of the electrode support member; and a conductive terminal for contacting the conductive foil to apply the voltage to the conductive foil.

2. The removable electrode according to claim 1, wherein the conductive foil is detachably attached to the opposite surface in a single layer or laminated layers.

3. The removable electrode according to claim 1, wherein the conductive foil is formed in a tape shape, and is movable intermittently or continuously along the opposite surface.

4. The removable electrode according to claim 3, wherein the electrode support member is formed of an insulating material, and includes a guide groove which guides the conductive foil moving along the opposite surface.

* * * * *